US012385380B1

(12) United States Patent
Alkhalifa et al.

(10) Patent No.: US 12,385,380 B1
(45) Date of Patent: Aug. 12, 2025

(54) ELECTRICAL SUBMERSIBLE PUMP CONCENTRIC TUBING COMPLETION

(71) Applicant: SAUDI ARABIAN OIL COMPANY, Dhahran (SA)

(72) Inventors: Mohammed Alkhalifa, Dhahran (SA); Ahmed Alsaleh, Dhahran (SA); Mohammed Alameer, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/671,864

(22) Filed: May 22, 2024

(51) Int. Cl.
*E21B 43/38* (2006.01)
*E21B 43/12* (2006.01)
*E21B 43/34* (2006.01)

(52) U.S. Cl.
CPC ..... *E21B 43/38* (2013.01); *E21B 43/128* (2013.01); *E21B 43/34* (2013.01)

(58) Field of Classification Search
CPC ..... E21B 43/38; E21B 43/128
See application file for complete search history.

(56) References Cited

U.S. PATENT DOCUMENTS 4,366,861 A 1/1983 Milam
5,271,725 A * 12/1993 Freet ..... E21B 43/121 417/572
6,179,056 B1 1/2001 Smith
6,336,503 B1 * 1/2002 Alhanati ..... E21B 43/385 166/313
6,547,003 B1 * 4/2003 Bangash ..... E21B 43/40 166/66.4
6,755,250 B2 6/2004 Hall et al.
8,448,699 B2 5/2013 Camilleri et al.
2008/0196902 A1 * 8/2008 Head ..... F04B 47/06 166/66.4
2008/0245525 A1 10/2008 Rivas et al.
2010/0089588 A1 * 4/2010 Thompson ..... E21B 43/38 166/372
2010/0258306 A1 * 10/2010 Camilleri ..... E21B 43/128 166/265
2013/0068455 A1 * 3/2013 Brown ..... E21B 36/006 166/66.4

(Continued)

FOREIGN PATENT DOCUMENTS

WO 2010118351 A1 10/2010

*Primary Examiner* — David Carroll
(74) *Attorney, Agent, or Firm* — Vorys, Sater, Seymour and Pease LLP

(57) ABSTRACT

A system for producing a wellbore fluid from a wellbore includes inner and outer tubing hangers at a surface location and inner and outer production tubing strings suspended from the inner and outer tubing hangers in a wellbore. A packer forms an annular seal around the outer production tubing string and an electrical submersible pump (ESP) is coupled in the inner production tubing string below the packer. A gas/liquid separator is coupled in the inner tubing string and is operable to discharge a liquid component of the wellbore fluid into the inner production tubing string and to discharge a gas component of the wellbore fluid into the lower portion of the wellbore annulus. The gas component may mix with the wellbore fluids in the lower portion of the wellbore annulus and the mixture enters an annular ventilation pathway between the production tubing strings to be vented to the surface location.

20 Claims, 3 Drawing Sheets

(56) References Cited

U.S. PATENT DOCUMENTS

| | | | | |
|---|---|---|---|---|
| 2016/0084052 | A1* | 3/2016 | Armistead | E21B 43/38 166/62 |
| 2022/0065090 | A1* | 3/2022 | Ejim | E21B 47/008 |
| 2023/0010704 | A1* | 1/2023 | Sheth | E21B 43/38 |

* cited by examiner

ELECTRICAL SUBMERSIBLE PUMP CONCENTRIC TUBING COMPLETION

FIELD OF THE DISCLOSURE

The present disclosure relates generally to wellbore systems including an electrical submersible pump (ESP) and, more particularly, to venting a gas component of a wellbore fluid from a lower portion of a wellbore annulus defined below a packer or another isolation device.

BACKGROUND OF THE DISCLOSURE

In oilfield production operations, valuable hydrocarbon fluids are drawn from subterranean locations to surface facilities or other collection locations through a wellbore. If these fluids do not readily flow to collection locations under existing natural forces, an electrical submersible pump (ESP) system may be installed in the wellbore to artificially lift the fluid. Gas production may generally be avoided by producing above a bubble point pressure. However, gas production may be unavoidable for wellbores producing below the bubble point pressure and should be either separated or handled. In many instances, the formation of free gas at the intake of a submersible pump of the ESP can severely damage the submersible pump or degrade its performance. In some environments, such wellbores with a high gas to oil ratio (GOR), a gas lockup condition can result in which the submersible pump is unable to deliver enough pressure to maintain continuous pumping.

When a packer is used above the submersible pump, free gas often accumulates below the packer and eventually creates a gas pocket that reaches the intake of the submersible pump. The free gas must be vented from the wellbore, or the gas lockup condition may be triggered. Without sufficient removal of the accumulated gas, the submersible pump can be exposed to free gas which reduces pumping efficiency and increases the possibility of reaching the gas lockup condition.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a system for producing a wellbore fluid from a wellbore includes an inner tubing hanger and an outer tubing hanger disposed at a surface location and defining an annular chamber therebetween. An inner production tubing string is suspended from the inner tubing hanger and an outer production tubing string is suspended from the outer tubing hanger. The inner and outer production tubing strings extend into the wellbore and define an annular ventilation pathway therebetween in fluid communication with the annular chamber. A packer forms an annular seal around the outer production tubing string and fluidly isolates an upper portion from a lower portion of a wellbore annulus around the outer production tubing string. An electrical submersible pump (ESP) is coupled in the inner production tubing string and is operable to propel the wellbore fluid through the inner tubing string to the surface location. A gas/liquid separator is coupled in the inner production tubing string. The gas/liquid separator is operable to discharge a liquid component of the wellbore fluid into the inner production tubing string and to discharge a gas component of the wellbore fluid into the lower portion of the wellbore annulus. An opening to the annular ventilation pathway is defined in the lower portion of the wellbore annulus through which a mixture of the gas component within the wellbore fluid may enter the ventilation pathway.

According to another example embodiment consistent with the present disclosure, a method for producing a wellbore fluid from a wellbore includes (a) operating a submersible pump to draw a wellbore fluid from a lower portion of a wellbore annulus into a gas/liquid separator, (b) separating a gas component from a liquid component of the wellbore fluid with the gas/liquid separator, (c) discharging the gas component from the gas/liquid separator into the lower portion of the wellbore annulus, (d) pumping the liquid component from the gas/liquid separator to a surface location through an inner production tubing string suspended from an inner tubing hanger at the surface location, and (e) venting a mixture of the gas component within the wellbore fluid through an annular ventilation pathway defined between the inner production tubing string and an outer production tubing string suspended from an outer tubing hanger at the surface location.

According to still another embodiment consistent with the present disclosure, a system for producing a wellbore fluid from a wellbore includes an inner tubing hanger and an outer tubing hanger disposed at a surface location and defining an annular chamber therebetween. An inner production tubing string is suspended from the inner tubing hanger and an outer production tubing string is suspended from the outer tubing hanger. The inner and outer production tubing strings extend into the wellbore and define an annular ventilation pathway therebetween in fluid communication with the annular chamber. A packer forms an annular seal around an exterior surface of the outer production tubing string and fluidly isolates an upper portion of a wellbore annulus around the outer production tubing string from a lower portion of the wellbore annulus. An electrical submersible pump (ESP) is coupled to the inner production tubing string below the packer and is operable to propel the wellbore fluid through the inner production tubing string to the surface location. A gas/liquid separator is coupled in the inner production tubing string below the packer, and the gas/liquid separator is operable to discharge a liquid component of the wellbore fluid into the inner production tubing string and to discharge a gas component of the wellbore fluid into the annular ventilation pathway through the lower portion of the wellbore annulus. An electrical cable extends through the annular ventilation pathway and is electrically coupled to the ESP.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
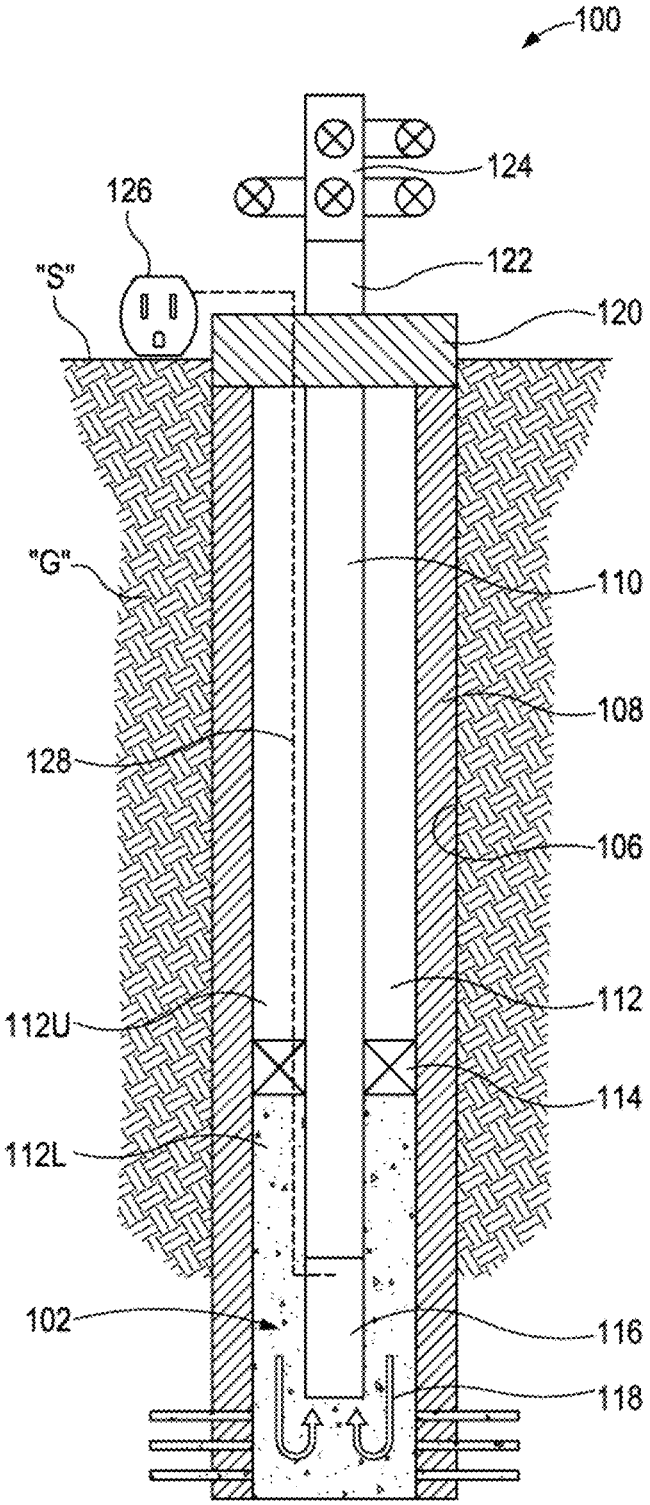
FIG. 1 is a cross-sectional view of an example wellbore system including an ESP system deployed in a production tubing string below a packer.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to a wellbore system and method for producing wellbore fluids from a wellbore which may be below a bubble point pressure for the wellbore fluid. The wellbore system includes an electrical submersible pump (ESP) system with a liquid-gas separator for lowering a gas volume fraction passing through an ESP. The ESP system also includes concentric production tubing strings extending through a casing. An inner production tubing string is provided for receiving wellbore liquids separated by the separator, and pumped by the ESP, and an outer production tubing string for receiving a mixture of the gas separated by the separator and the fluids flowing from the surrounding geologic formation. A packer or other isolation device is positioned between the outer production tubing string and a wellbore casing, but no packer or isolation device forms a seal around the inner production tubing string. The concentric production tubing strings extend to a dual wellhead with a ventilation port fluidly coupled to an annular ventilation pathway between the concentric production tubing strings. The gas separated by the separator may be mixed with the wellbore fluids and vented through the ventilation port. The dual wellhead also includes an outer tubing hanger and an inner tubing hanger supported by a wellhead. In some embodiments, an electrical cable may extend through the annular ventilation pathway to bypass the packer.

FIG. 1 illustrates an example embodiment of a wellbore system 100 that includes an ESP system 102. The ESP system 102 is disposed in a wellbore 106 extending from a surface location "S" and traversing a geologic formation "G." In the illustrated example, the wellbore 106 is substantially vertical. In other embodiments, aspects of the disclosure may be practiced in a wide variety of vertical, directional, deviated, slanted and/or horizontal portions therein, and may extend along any trajectory through the geologic formation "G." As illustrated in FIG. 1, the wellbore 106 is lined with a casing string 108, however, in other embodiments, the wellbore 106, or portions of the wellbore 106, may be open hole and otherwise not cased.

In the example embodiment illustrated, the ESP system 102 is deployed (conveyed downhole) on a production tubing string 110. In other embodiments, the ESP system 102 may be deployed on other wellbore conduits or conveyances, such as coiled tubing. A wellbore annulus 112 is defined radially between the production tubing string 110 and the surrounding structure, e.g., the casing string 108. The production tubing string 110 extends through an isolation device, such as packer 114, that forms a seal with the production tubing string 110 and the surrounding casing string 108. The packer 114 fluidly isolates a lower portion 112L of the wellbore annulus 112 surrounding the ESP system 102 from an upper portion 114U above the packer 114.

The ESP system 102 includes a submersible pump 116 coupled at a lower end of the production tubing string 110. The submersible pump 116 may be a multi-stage centrifugal pump that operates by transferring pressure to the wellbore fluids 118 to propel the wellbore fluids 118 to the surface location "S" at a desired pumping rate. The submersible pump 116 may have any suitable size or construction based on the characteristics, e.g., wellbore size, desired pumping rate, etc., of the wellbore operation for which the submersible pump 116 is employed. The submersible pump 116 may operate to transfer pressure to the wellbore fluids 118 by employing a motor (not shown) operably coupled to one or more impellers (not shown) and diffusers (not shown) as generally recognized in the art.

The wellbore fluids 118 may include oil and dissolved gas, and may travel through the production tubing string 110 to a wellhead 120 at the surface location "S." The wellhead 120 generally provides a suspension point for the casing string 108 and the production tubing string 110. For example, the wellhead 120 includes a tubing hanger 122 coupled to an upper end of the production tubing string 110 from which the production tubing string 110 may be suspended in the wellbore 106. A Christmas tree 124 is provided above the wellhead 120, which generally provides pressure control for the wellbore 106. The Christmas tree 124 may include a system of valves and adaptors in fluid communication with the production tubing string 110 that distribute the wellbore fluids 118 produced through the production tubing string 110 to appropriate destinations remote from the wellbore 106. For example, wellbore fluids 118 may be directed from the production string 110 to a collection tank, a pipeline or another destination (not shown).

The submersible pump 116 may be powered by an electrical power source 126 disposed at the surface location "S." The electrical power source 126 may include one or more batteries, a generator or any other available source of electrical power. An electrical cable 128 extends from the electrical power source 126 along an outside surface of the production tubing string 110 to the submersible pump 116. The electrical cable 128 may penetrate or pass through the packer 114 installed around the production tubing string 110.

If a pressure of the wellbore fluids 118 in the lower portion 112L of the wellbore annulus 112 is above a bubble point pressure, gas production through the submersible pump 116 may be avoided. However, gas production may be unavoidable if the wellbore 106 is producing below bubble point pressure. In this case, the gas may either be separated or handled. Separation of the gas from a liquid component of the wellbore fluids 118 may be particularly helpful when there is a ventilation path for the separated gas to exit the wellbore 106. The packer 114 installed around the production tubing string 110 may present a barrier to the ventilation of free gas (e.g., the gas component 208 of FIG. 2) and therefore, gas handling may be more appropriate when the wellbore 106 produces below the bubble point pressure.

Gas handling may encompass a collection of distinct solutions designed to ease the flow of the gas through the submersible pump 116 and reduce gas locking. These solutions may include one or more helico-axial stages of the submersible pump 116, which are commonly referred to as "gas handlers," as well as tapered pumps and other designs that serve to homogenize the gas-fluid mixture. When handled properly, gas provides natural buoyancy to the wellbore fluids 118, thus allowing an operator to improve lifting efficiency and recover the wellbore fluids 118 to the surface location "S" more quickly. In some embodiments, a gas separator may be placed below a set of helico-axial stages to remove larger gas bubbles, while the helico-axial stages of the submersible pump 116 help trap the smaller bubbles in the wellbore fluid 118 before entering and damaging the submersible pump 116.

Figure 2:
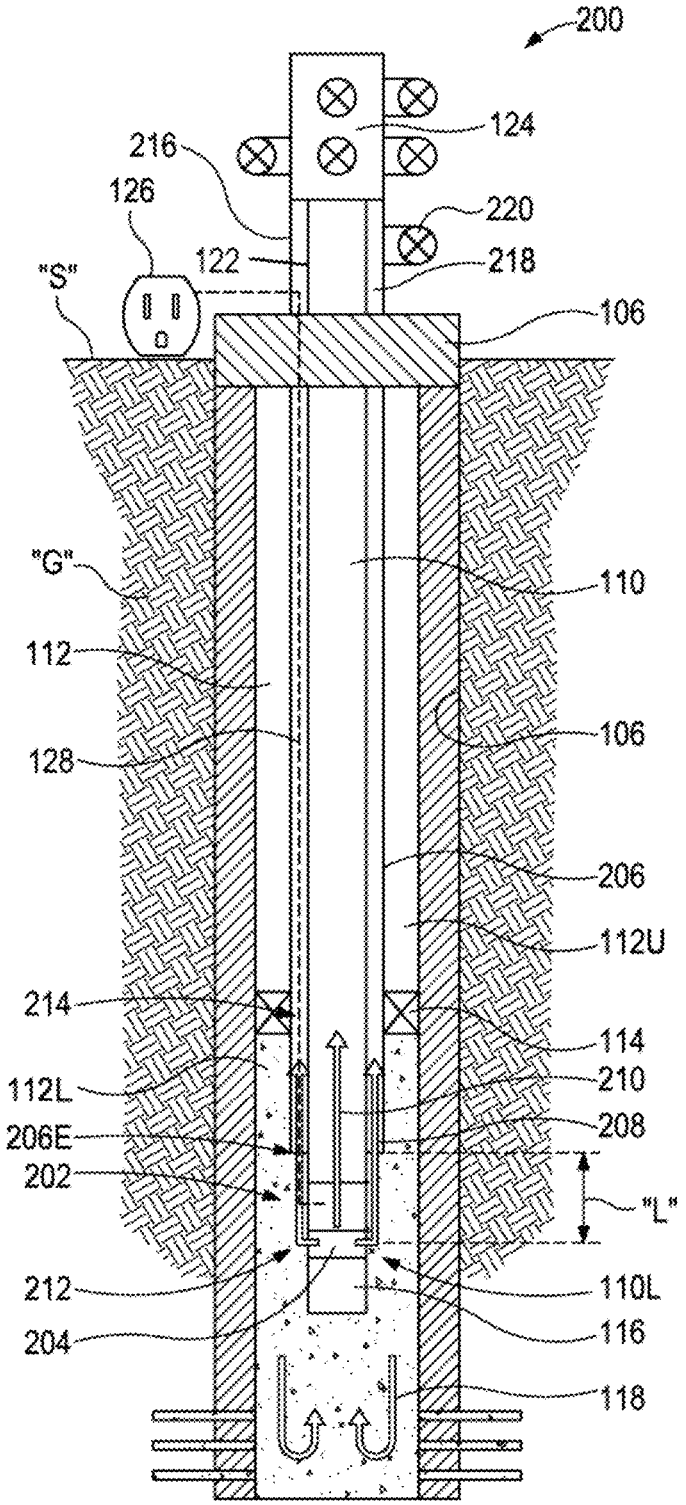
FIG. 2 is a cross-sectional view of a wellbore system including an ESP system deployed in an inner production tubing string of a concentric production tubing string completion in accordance with at least one aspect of the present disclosure.

Referring now to FIG. 2, illustrated is another example wellbore system 200 that includes an ESP system 202 in accordance with example embodiments of the present disclosure. The ESP system 202 is disposed in the wellbore 106 at the lower end of the production tubing string 110, similar to the ESP system 102 of the wellbore system 100 of FIG. 1 described above. In the wellbore system 200, however, the ESP system 202 also includes a gas/liquid separator 204 installed within the submersible pump 116 and an outer production tubing string 206 circumscribing the inner production tubing string 110.

The submersible pump 116 and the gas/liquid separator are coupled in a lower portion 110L of the inner production tubing string 110 protruding through an open longitudinal end 206E of the outer production tubing string 206. In some embodiments, the submersible pump 116 may define a lowermost (most downhole) component of the inner production tubing string 110. In the wellbore system 200, the packer 114 forms a seal with the outer production tubing string 206 to isolate the upper portion 112U from the lower portion 112L of the wellbore annulus 112. As may be appreciated by those skilled in the art, the packer 114 helps maintain the integrity and efficiency of the wellbore system 200.

The gas/liquid separator 204 may employ inverted shrouds, cyclonic motion, internal baffling and/or other mechanisms for separating the wellbore fluids 118 into a gas component 208 and a liquid component 210. The liquid component 210 may be discharged from the gas/liquid separator 204 and into the interior of the inner production tubing string 110, and subsequently pumped uphole to the Christmas tree 124 by the submersible pump 116, as generally described above. The liquid component 210 may then be distributed through the Christmas tree 124 to an appropriate destination remote from the wellbore 106.

In contrast, the gas component 208 may be expelled through one or more radial discharge ports 212 defined in the gas/liquid separator 204 and discharged into the lower portion 112L of the wellbore annulus 112 below the packer 114. The packer 114 may not provide a ventilation pathway therethrough for the gas component 208, and thus, the gas component 208 may be mixed with the wellbore fluids 118 within the lower portion 112L of the wellbore annulus 112, and may be produced through an annular ventilation pathway 214 defined between the outer production tubing string 206 and the inner production tubing string 110. In some embodiments, the inner and outer production tubing strings 110, 206 are concentrically arranged with respect to one another such that the annular ventilation pathway 214 uniformly surrounds the inner production tubing string 110.

The gas component 208 mixes with the existing column of wellbore fluids 118, which may be primarily liquid oil. Due to the mixing, the wellbore fluids 118 may become more buoyant, and rise along a vertical length "L" between the radial discharge ports 212 and an opening defined at a lower longitudinal end 206E of the outer production tubing string 206 before entering the annular ventilation pathway 214. An annular opening to the annular ventilation pathway 214 is defined within the lower portion 112L of the wellbore annulus 112 between the longitudinal end 206E of the outer production tubing string 206 and the lower portion 110L of the inner production tubing string 110. The vertical length "L" allows the gas component 208 to effectively mix with the wellbore fluids 118 before entering the annular ventilation pathway 214.

The inner and outer production tubing strings 110, 206 extend upwardly all the way to the wellhead 120 where inner production tubing string 104 is suspended by the inner tubing hanger 122 and the outer production tubing string 206 is suspended from an outer tubing hanger 216. The annular ventilation pathway 214 extends the entire length of the outer production tubing string 206, which may be devoid of any seals or obstructions therein. An annular chamber 218 is defined between the inner tubing hanger 122 and the outer tubing hanger 216, which is in fluid communication with the annular ventilation pathway 214. A ventilation port 220 extends through the outer tubing hanger 216 to permit the gas component 208 mixed in with the wellbore fluids to be ventilated from the wellbore 106.

As described above, the submersible pump 116 may be powered by the electrical power source 126 disposed at the surface location "S." In the wellbore system 200, the electrical cable 128 extends from the electrical power source 126 through the annular ventilation pathway 214 along the outside surface of the inner production tubing string 110 to the submersible pump 116. The electrical cable 128 may bypass, or pass around, the packer 114, which is installed around the electrical cable 128 and the outer production tubing string 206. In some embodiments, the electrical cable 128 will be attached to the inner production tubing string 110 using standard cable clamps (not shown) installed thereon. The electrical cable 128 will be installed along with the inner production tubing string 110 after completing the outer production tubing string 206 installation. Accordingly, the electrical cable 128 will be disposed between the two inner and outer production tubing strings 110, 206.

Figure 3:
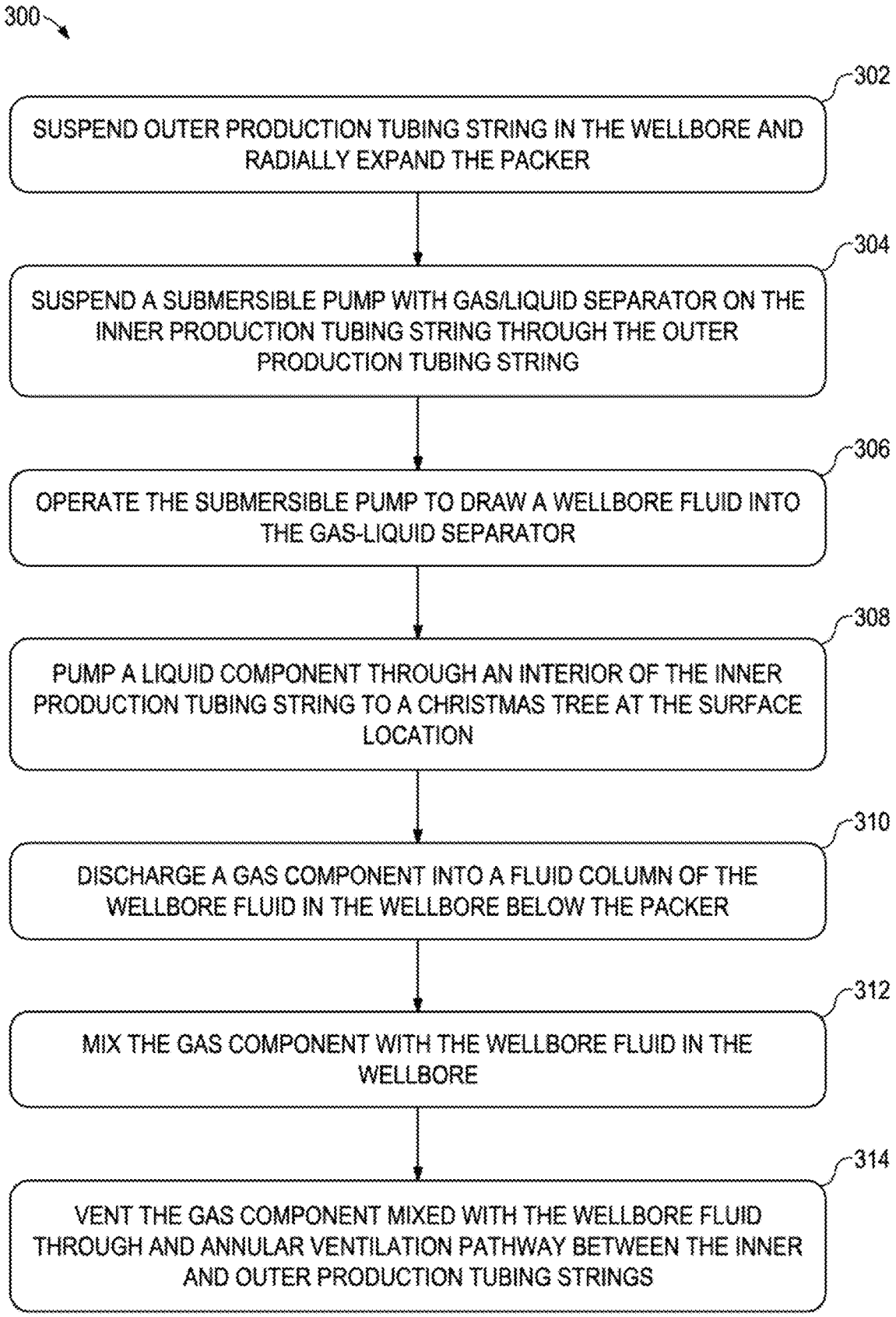
FIG. 3 is a flowchart illustrating a procedure for installing and operating the wellbore system of FIG. 2 in accordance with at least one aspect of the present disclosure.

Referring now to FIG. 3, a procedure 300 for installing and operating the wellbore system 200 is described in accordance with at least one aspect of the present disclosure. Although the example method 300 depicts a particular sequence of operations, the sequence may be altered without departing from the scope of the present disclosure. For example, some of the operations depicted may be performed in parallel or in a different sequence that does not materially affect the function of the procedure 300. In other examples, different components of an example system that implements the procedure 300 may perform functions at substantially the same time or in a specific sequence. Initially at step 302, the outer production tubing string 206 may be suspended in the wellbore 106. For example, the outer production tubing string 206 may be run into the wellbore with the packer 114 installed around a lower portion thereof. Once the packer 114 is appropriately positioned, the outer tubing string 206 may be suspended from the outer tubing hanger 216 and the packer 114 may be radially expanded to engage the casing string 108 (or the geologic formation "G"). Expanding the packer 114 isolates the upper portion 112U of the wellbore annulus 112 from the lower portion 112L. Next, at step 304, the submersible pump 116 along with the gas/liquid separator 204 may be run into the wellbore 106 on the inner production tubing string 110. The inner production tubing string 110 may be lowered through the outer tubing string 206 to establish the annular ventilation pathway 214 between the inner and outer production tubing strings 110, 206. Once the submersible pump 116 and the gas/liquid separator 204 are appropriately positioned, e.g., protruding from the lower end of the outer tubing string 206, the inner production tubing string 110 may be hung from the inner tubing hanger 122.

At step 306, the submersible pump 116 may be operated to draw the wellbore fluid 118 from the lower portion 112L of the wellbore annulus 112 into the gas/liquid separator 204. The submersible pump 116 may be powered by the electrical power source 126 at the surface location through the electrical cable 128. The gas/liquid separator 204 separates the wellbore fluid into the liquid component 210 and the gas component 208. The liquid component 210 may be pumped (at step 308) through an interior of the inner production tubing string 110 to the surface location "S." The liquid component 210 may be distributed by the Christmas tree 124 to an appropriate location or destination remote from the wellbore 106 for further processing or consumption. The gas component 208 may be discharged through the radial discharge ports 212 back into the lower portion 112L of the wellbore annulus 112 at step 310. The gas component 208 rejoins the column of wellbore fluids 118 below the packer 114. At step 312, the gas component 208 mixes with the wellbore fluids 118, which may make the wellbore fluids 118 more buoyant. In some embodiments, the gas component 208 will mix naturally with wellbore fluids 118 since the gas component 208 has high solubility/miscibility, and the pressure difference between the gas component 208 and the wellbore fluids 118 may not be sufficiently great to maintain a separation between the gas component 208 and the wellbore fluids 118. At step 314, the gas component 208 mixed together with the wellbore fluids 118 may be vented through the annular ventilation pathway 214 between the inner and outer production tubing strings 110, 206. The gas component 208 may be discharged through the annular chamber 218 and ventilation port 220 for distribution to an appropriate remote location. The procedure 300 thus enables installation of a submersible pump 116 in wellbores 106 with higher gas volume fraction while improving the operational efficiency and reliability of the submersible pump 116.

Embodiments disclosed herein include:

A. A system for producing a wellbore fluid from a wellbore. The system includes an inner tubing hanger and an outer tubing hanger disposed at a surface location and defining an annular chamber therebetween. An inner production tubing string is suspended from the inner tubing hanger and an outer production tubing string suspended from the outer tubing hanger. The inner and outer production tubing strings extend into the wellbore and define an annular ventilation pathway therebetween in fluid communication with the annular chamber. A packer forms an annular seal around the outer production tubing string and fluidly isolating an upper portion from a lower portion of a wellbore annulus around the outer production tubing string. An electrical submersible pump (ESP) is coupled in the inner production tubing string and is operable to propel the wellbore fluid through the inner tubing string to the surface location. A gas/liquid separator is coupled in the inner production tubing string. The gas/liquid separator is operable to discharge a liquid component of the wellbore fluid into the inner production tubing string and to discharge a gas component of the wellbore fluid into the lower portion of the wellbore annulus. The system also includes an opening to the annular ventilation pathway defined in the lower portion of the wellbore annulus through which a mixture of the gas component within the wellbore fluid may enter the ventilation pathway.

B. A method for producing a wellbore fluid from a wellbore. The method includes (a) operating a submersible pump to draw a wellbore fluid from a lower portion of a wellbore annulus into a gas/liquid separator, (b) separating a gas component from a liquid component of the wellbore fluid with the gas/liquid separator, (c) discharging the gas component from the gas/liquid separator into the lower portion of the wellbore annulus, (d) pumping the liquid component from the gas/liquid separator to a surface location through an inner production tubing string suspended from an inner tubing hanger at the surface location, and (e) venting a mixture of the gas component within the wellbore fluid through an annular ventilation pathway defined between the inner production tubing string and an outer production tubing string suspended from an outer tubing hanger at the surface location.

C. A system for producing a wellbore fluid from a wellbore. The system includes an inner tubing hanger and an outer tubing hanger disposed at a surface location and defining an annular chamber therebetween. The system also includes an inner production tubing string suspended from the inner tubing hanger and an outer production tubing string suspended from the outer tubing hanger. The inner and outer production tubing strings extend into the wellbore and define an annular ventilation pathway therebetween in fluid communication with the annular chamber. A packer forms an annular seal around an exterior surface of the outer production tubing string and fluidly isolates an upper portion of a wellbore annulus around the outer production tubing string from a lower portion of the wellbore annulus. An electrical submersible pump (ESP) is coupled to the inner production tubing string below the packer and is operable to propel the wellbore fluid through the inner production tubing string to the surface location. A gas/liquid separator is coupled in the inner production tubing string below the packer. The gas/liquid separator is operable to discharge a liquid component of the wellbore fluid into the inner production tubing string and to discharge a gas component of the wellbore fluid into the annular ventilation pathway through the lower portion of the wellbore annulus. The system further includes an electrical cable extending through the annular ventilation pathway and electrically coupled to the ESP.

Each of embodiments A through C may have one or more of the following additional elements in any combination: Element 1: further comprising a ventilation port defined through the outer tubing hanger through which the mixture of the gas component within the wellbore fluid may be directed to a remote location with respect to the wellbore through the ventilation port. Element 2: further comprising a Christmas tree disposed at the surface location and fluidly coupled to the inner production tubing string such that the liquid component of the wellbore fluid may be directed to a remote location with respect to the wellbore through the Christmas tree. Element 3: wherein the opening to the annular ventilation pathway annular is an annular opening defined between an open longitudinal end of the outer production tubing string and a lower portion of the inner production tubing string protruding through the longitudinal end of the outer production tubing string. Element 4: wherein the ESP and the gas/liquid separator are coupled in the lower portion of the inner production tubing string below the annular opening, and wherein the gas/liquid separator includes radial discharge ports through which the gas component may be discharged into the lower portion of the wellbore annulus. Element 5: wherein the annular ventilation path extends an entire length of the outer production tubing string between the longitudinal end and the outer tubing hanger. Element 6: wherein the gas/liquid separator is installed within the ESP such that operation of the ESP draws the wellbore fluid into the gas/liquid separator. Element 7: further comprising an electrical cable extending through the annular ventilation pathway and electrically coupled to the ESP.

Element 8: further comprising directing the mixture of the gas component within the wellbore fluid through a ventilation port defined through the outer tubing hanger to a remote location with respect to the wellbore through the ventilation port. Element 9: further comprising directing the liquid component through a Christmas tree fluidly coupled to the inner production tubing string. Element 10: wherein venting the mixture of the gas component within the wellbore fluid includes passing the mixture through an annular opening to the annular ventilation pathway defined between an open longitudinal end of the outer production tubing string and a lower portion of the inner production tubing string protruding through the longitudinal end of the outer tubing string. Element 11: wherein discharging the gas component from the gas/liquid separator includes supporting the gas/liquid separator within the lower portion of the inner production tubing string and discharging the gas component through radial discharge ports defined in the gas/liquid separator. Element 12: wherein venting the mixture includes passing the mixture through an entire length of the outer production tubing string through the annular ventilation pathway. Element 13: further comprising powering the submersible pump with an electrical cable extending through the annular ventilation pathway. Element 14: further comprising installing a packer around the outer production tubing string and the electrical cable to fluidly isolate the lower portion of the wellbore annulus from an upper portion of the wellbore annulus.

Element 15: wherein the electrical cable extends to an electrical power source at the surface location. Element 16: wherein the ESP and the gas/liquid separator are coupled in a lower portion of the inner production tubing string extending below an open longitudinal end of the outer production tubing string. Element 17: wherein the electrical cable extends along an exterior surface of the inner production tubing string below the longitudinal end of the outer production tubing string.

By way of non-limiting example, exemplary combinations applicable to A through C include: Element 1 with Element 2; Element 3 with Element 4; Element 4 with Element 5; Element 8 with Element 9; Element 10 with Element 11; Element 11 with Element 12; Element 13 with Element 14; and Element 16 with Element 17.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A system for producing a wellbore fluid from a wellbore, the system comprising:

an inner tubing hanger and an outer tubing hanger disposed at a surface location and defining an annular chamber therebetween;

an inner production tubing string suspended from the inner tubing hanger and an outer production tubing string suspended from the outer tubing hanger, the inner and outer production tubing strings extending into the wellbore and defining an annular ventilation pathway therebetween in fluid communication with the annular chamber;

a packer forming an annular seal around the outer production tubing string and fluidly isolating an upper portion from a lower portion of a wellbore annulus defined between the outer production tubing string and an inner wall of the wellbore;

an electrical submersible pump (ESP) coupled in the inner production tubing string and operable to propel the wellbore fluid through the inner tubing string to the surface location;

a gas/liquid separator coupled in the inner production tubing string and being operable to discharge a liquid component of the wellbore fluid into the inner production tubing string and to discharge a gas component of the wellbore fluid into the lower portion of the wellbore annulus; and an annular opening to the annular ventilation pathway defined in the lower portion of the wellbore annulus and extending radially between an open longitudinal end of the outer production tubing string and a lower portion of the inner production tubing string in which the ESP is coupled protruding through the open longitudinal end of the outer production tubing string and through which a mixture of the gas component within the wellbore fluid may enter the ventilation pathway.

2. The system of claim 1, further comprising a ventilation port defined through the outer tubing hanger through which the mixture of the gas component within the wellbore fluid is directed to a remote location with respect to the wellbore through the ventilation port.

3. The system of claim 2, further comprising a Christmas tree disposed at the surface location and fluidly coupled to the inner production tubing string such that the liquid component of the wellbore fluid is directed to a remote location with respect to the wellbore through the Christmas tree.

4. The system of claim 1, wherein the gas/liquid separator includes one or more radial discharge ports through which the gas component is discharged into the lower portion of the wellbore annulus.

5. The system of claim 4, wherein the annular ventilation path extends an entire length of the outer production tubing string between the open longitudinal end and the outer tubing hanger.

6. The system of claim 1, wherein the gas/liquid separator is installed within the ESP such that operation of the ESP draws the wellbore fluid into the gas/liquid separator.

7. The system of claim 1, further comprising an electrical cable extending through the annular ventilation pathway and electrically coupled to the ESP.

8. A method for producing a wellbore fluid from a wellbore, the method comprising:

operating a submersible pump to draw a wellbore fluid from a lower portion of a wellbore annulus into a gas/liquid separator;

separating a gas component from a liquid component of the wellbore fluid with the gas/liquid separator;

discharging the gas component from the gas/liquid separator into the lower portion of the wellbore annulus;

pumping the liquid component from the gas/liquid separator to a surface location through an inner production tubing string suspended from an inner tubing hanger at the surface location; and venting a mixture of the gas component within the wellbore fluid through an annular opening defined in the lower portion of the wellbore annulus and extending radially between an open longitudinal end of an outer production tubing string suspended from an outer tubing hanger at the surface location and a lower portion of the inner production tubing string protruding through the open longitudinal end of the outer production tubing string and in which the submersible pump is coupled, and into an annular ventilation pathway defined between the inner production tubing string and the outer production tubing string.

9. The method of claim 8, further comprising directing the mixture of the gas component within the wellbore fluid through a ventilation port defined through the outer tubing hanger to a remote location with respect to the wellbore through the ventilation port.

10. The method of claim 9, further comprising directing the liquid component through a Christmas tree fluidly coupled to the inner production tubing string.

11. The method of claim 8, wherein discharging the gas component from the gas/liquid separator includes supporting the gas/liquid separator within the lower portion of the inner production tubing string and discharging the gas component through radial discharge ports defined in the gas/liquid separator.

12. The method of claim 11, wherein venting the mixture includes passing the mixture through an entire length of the outer production tubing string through the annular ventilation pathway.

13. The method of claim 8, further comprising powering the submersible pump with an electrical cable extending through the annular ventilation pathway.

14. The further of claim 13, further comprising installing a packer around the outer production tubing string and the electrical cable to fluidly isolate the lower portion of the wellbore annulus from an upper portion of the wellbore annulus.

15. The method of claim 8, further comprising:

running the packer into the wellbore on the outer production tubing string;

suspending the outer production tubing string on the outer tubing hanger; and radially expanding the packer.

16. The method of claim 15, further comprising:

lowering the submersible pump and the gas/liquid separator through the open longitudinal end of the outer production tubing string on the inner production tubing string; and hanging the inner production tubing string from the inner tubing hanger subsequent to lowering the submersible pump and the gas/liquid separator.

17. A system for producing a wellbore fluid from a wellbore, the system comprising:

an inner tubing hanger and an outer tubing hanger disposed at a surface location and defining an annular chamber therebetween;

an inner production tubing string suspended from the inner tubing hanger and an outer production tubing string suspended from the outer tubing hanger, the inner and outer production tubing strings extending into the wellbore and defining an annular ventilation pathway therebetween in fluid communication with the annular chamber;

a packer forming an annular seal around an exterior surface of the outer production tubing string and fluidly isolating an upper portion of a wellbore annulus around the outer production tubing string from a lower portion of the wellbore annulus;

an electrical submersible pump (ESP) coupled to the inner production tubing string below the packer and operable to propel the wellbore fluid through the inner production tubing string to the surface location;

a gas/liquid separator coupled in the inner production tubing string below the packer, the gas/liquid separator operable to discharge a liquid component of the wellbore fluid into the inner production tubing string and to discharge a gas component of the wellbore fluid into the annular ventilation pathway through the lower portion of the wellbore annulus and an annular opening defined in the lower portion of the wellbore annulus and extending radially between an open longitudinal end of the outer production tubing string and a lower portion of the inner production tubing string protruding through the open longitudinal end of the outer production tubing string and in which the ESP is coupled; and an electrical cable extending through the annular ventilation pathway and electrically coupled to the ESP.

18. The system of claim 17, wherein the electrical cable extends to an electrical power source at the surface location.

19. The system of claim 17, wherein the gas/liquid separator is coupled in the lower portion of the inner production tubing string.

20. The system of claim 19, wherein the electrical cable extends along an exterior surface of the inner production tubing string below the longitudinal end of the outer production tubing string in the drill string.

* * * * *